US007766466B2

(12) United States Patent
Taniguchi et al.

(10) Patent No.: US 7,766,466 B2
(45) Date of Patent: Aug. 3, 2010

(54) INK SUPPLY METHOD AND PRINTING APPARATUS

(75) Inventors: Suguru Taniguchi, Kawasaki (JP); Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 680 days.

(21) Appl. No.: 11/455,182

(22) Filed: Jun. 19, 2006

(65) Prior Publication Data

US 2006/0290751 A1 Dec. 28, 2006

(30) Foreign Application Priority Data

Jun. 24, 2005 (JP) ..... 2005-185744

(51) Int. Cl.
*B41J 2/175* (2006.01)

(52) U.S. Cl. ..... 347/85; 347/87

(58) Field of Classification Search ..... 347/84, 347/85, 86

See application file for complete search history.

(56) References Cited

U.S. PATENT DOCUMENTS

| | | | | |
|---|---|---|---|---|
| 5,701,149 | A * | 12/1997 | Pagnon et al. | 347/89 |
| 6,540,321 | B1 * | 4/2003 | Hirano et al. | 347/22 |
| 6,612,683 | B2 * | 9/2003 | Takahashi et al. | 347/30 |
| 6,637,872 | B2 * | 10/2003 | Ara et al. | 347/85 |
| 6,773,089 | B2 | 8/2004 | Inoue et al. | 347/40 |
| 6,840,610 | B2 | 1/2005 | Taniguchi et al. | 347/86 |
| 7,021,731 | B2 | 4/2006 | Mizoguchi et al. | 347/7 |

FOREIGN PATENT DOCUMENTS

| | | |
|---|---|---|
| JP | 8-112913 | 5/1996 |
| JP | 2003-246077 | 9/2003 |
| JP | 2003-326721 | 11/2003 |
| JP | 2004-181952 | 7/2004 |
| JP | 2004-195957 | 7/2004 |

OTHER PUBLICATIONS

Japanese Office Action dated May 14, 2010, from corresponding Japanese Application No. 2005-185744, and English language translation thereof.

* cited by examiner

*Primary Examiner*—Anh T. N. Vo
(74) *Attorney, Agent, or Firm*—Fitzpatrick, Cella, Harper & Scinto

(57) ABSTRACT

The present invention relates to an ink supply method and a printing apparatus by which, when an ink supply operation is repeated by using a gas-liquid separation member, damage to the gas-liquid separation member can be reduced to improve the reliability. In order to realize this, an ink supply method for aspirating air in a sub tank via the gas-liquid separation member to supply ink from a supply opening into the sub tank sets a plurality of different amounts as an suction amount of air in the sub tank per a unit time.

8 Claims, 10 Drawing Sheets

INK SUPPLY METHOD AND PRINTING APPARATUS

BACKGROUND OF THE INVENTION

1. Field of the Invention

The present invention relates to an ink supply method for supplying ink to an ink container and a printing apparatus using the ink supply method. In particular, the present invention relates to an ink supply method for supplying ink by using a gas-liquid separation member that permits gas to pass therethrough and that prevents liquid from passing therethrough and a printing apparatus.

2. Description of the Related Art

One of conventional ink jet printing apparatuses is shown in FIG. 9. This ink jet printing apparatus is a serial scan-type printing apparatus in which a printing operation is performed by moving a printing head 1 on a printing medium in a main scanning direction of an arrow X while the printing head 1 is guided by a guide axis 8. This method as shown in FIG. 9 is a so-called head cartridge method that is one of methods for supplying ink to the printing head 1. In this head cartridge method, a head cartridge 1*b* is composed of the printing head 1 including a nozzle that can eject ink; and a main tank 4 for storing ink to be supplied to the printing head 1. This method provides printing and scanning operations by moving a carriage 1*a* having the head cartridge 1*b* along a guide axis 8 in the main scanning direction.

Another method for supplying ink to the printing head 1 is a tank cartridge method as shown in FIG. 10. According to this method, the printing head 1 is mounted on the carriage 1*a* and a tank cartridge 1*c* for storing ink to be supplied to the printing head 1 is provided at the body of the printing apparatus. Ink is supplied from the tank cartridge 1*c* to the printing head 1 via a flexible ink supply tube 1*d* connecting the printing head 1 to the tank cartridge *c*.

However, the former head cartridge method mounts the head cartridge 1*b* including the ink tank 4 on the carriage 1*a* and thus the carriage 1*a* has a high laden weight. This prevents the carriage 1*a* from moving with a high speed. Furthermore, when the head cartridge 1*b* has a reduced size in order to reduce the laden weight of the carriage 1*a*, the ink tank 4 has a reduced capacity, causing a reduced number of printable printing media. In the case of the latter tank cartridge method, the ink cartridge 1*c* at the printing apparatus body is connected to the printing head 1 at the carriage 1*a* via the ink supply tube 1*d*, which causes a complicated ink supply mechanism to make it difficult to reduce the size of the printing apparatus.

In order to solve the inconveniences of the conventional ink supply methods as described above, the so-called pit-in method has been considered. This supply method is used in the serial scan type printing apparatus as described above so that a printing head and a sub tank having a relatively small capacity are mounted on a carriage and a main tank having a relatively large capacity is provided at the body of the printing apparatus. The sub tank is a tank for storing ink to be supplied to the printing head and is supplied with ink from the main tank when the sub tank and the carriage are moved to a predetermined home position. Specifically, when the carriage is moved to the home position, an ink supply section of the sub tank is connected with a joint of the main tank to form an ink supply path. Then, ink is supplied from the main tank to the sub tank by using a negative pressure generating unit to decompress the interior of the sub tank.

The pit-in method as described above uses a sub tank having a small capacity mounted on a carriage and thus a laden weight on the carriage can be reduced, thus allowing the printing head to perform printing and scanning with a high speed. Furthermore, the ink supplied from the main tank to the sub tank at the home position can increase the number of printing media to be printed. Furthermore, the pit-in method does not require the carriage to be connected to the tank via an ink supply tube as in the tank cartridge method of FIG. 10, thus simplifying the structure of the apparatus.

With regards to the pit-in type ink jet printing apparatus as described above, a method has been disclosed for controlling an ink supply system by using a sensor to detect an ink amount that can be supplied to the subtank when the carriage is moved to the home position as a mechanism for replenishing ink from the main tank to the sub tank (see Japanese Patent Application Laid-open No. 08-112913 (1996)). However, the control of the ink amount using the sensor as described above is complicated, thus causing the resultant apparatus to have an increased price.

From the viewpoint as described above, a pit-in type ink jet printing apparatus has been suggested in which a sub tank includes a gas-liquid separation member to simplify the control of an ink supply amount (see Japanese Patent Application Laid-open No. 2004-181952).

FIG. 5 is a schematic cross sectional view of a printing head in the pit-in type ink jet printing apparatus as described above. FIG. 6 is a cross-sectional view taken along the line VI-VI of FIG. 5.

A printing head of this example includes a sub tank 3 and an ink jet printing element 38. This printing head is mounted on a carriage of a serial scan-type ink jet printing apparatus. An ink reservoir portion R of the sub tank 3 includes an ink absorption member 37. An ink reservoir portion-constituting member 35 is attached with a gas-liquid separation member 33 that is positioned at a boundary between an exhaust path 36 and the ink reservoir portion R. The gas-liquid separation member 33 is a member that allows gas to pass therethrough but blocks liquid such as ink. The gas-liquid separation member 33 is a porous film formed by PTFE having a thickness of about several tens micrometers for example. The ink reservoir portion R is divided into the three sections as shown in FIG. 6 and the respective sections store different colors of inks. The ink jet printing element 38 includes ink ejection openings that can eject these inks.

At the boundary between the three ink reservoir portions R and the exhaust path 36 common to them, the one gas-liquid separation member 33 is positioned. The gas-liquid separation member 33 is heat-deposited with the inner side of a rib 35A formed at the outer periphery of the ink reservoir portion-constituting member 35. The three ink reservoir portions R are separated from one another and the top part thereof and the one exhaust path 36 have therebetween the one gas-liquid separation member 33. The reference numeral 34 denotes a member constituting the exhaust path.

When ink is supplied from the main tank to the sub tank 3, the carriage is moved to the home position. The main tank stores therein the respective inks to be supplied to the respective ink reservoir portions R. As shown in FIG. 5, an ink ejection opening of the ink jet printing element 38 is sealed by a dummy cap 6 and ink supply openings 11 of the respective ink reservoir portions R are connected to the corresponding respective Joints 10 of the main tank. An suction cap 22 of the body of the printing apparatus is also connected to a vent hole 15 of the sub tank 3. Then, a negative pressure generating unit included in the printing apparatus is activated to exhaust air in the respective ink reservoir portions R via the gas-liquid separation member 33, the exhaust path 36, the vent hole 15, and the suction cap 22. This decompresses the interior of the respective ink reservoir portions R to allow the respective corresponding colors of ink to be supplied from the main tank into the respective ink reservoir portions R via the respective joints 10, the respective ink supply openings 11, and the respective ink supply paths 12. When the interior of the ink reservoir portion R is filled with ink and the fluid level of the ink reaches the gas-liquid separation member 33, the gas-liquid separation member 33 will automatically stop the supply of ink. Thus, the respective ink reservoir portions R can be automatically supplied with ink until they are filled with the corresponding inks without requiring a special control of an amount of supplied ink.

Thus, by setting an air intake amount of the negative pressure generating unit to be equal to or higher than the total of the inner volumes of the respective ink reservoir portions R, air in the respective ink reservoir portions R is exhausted, regardless of the amount of ink left in the respective ink reservoir portions R, via the gas-liquid separation member 33 to subsequently supply ink to the respective ink reservoir portions R until they are filled up with ink. In this manner, the respective ink reservoir portions R can be filled up with ink by exhausting air in an amount equal to or higher than a predetermined amount from the respective ink reservoir portions R. Thus, control of air exhaust is not required and thus the negative pressure generating unit can be designed with a sufficient margin.

In the structure according to the pit-in method of FIG. 6, the interior of the sub tank 3 is divided into the three ink reservoir portions R and the one gas-liquid separation member 33 is deposited, in order to improve the assembly, with the inner side of the rib 35A formed at the outer periphery of the ink reservoir portion-constituting member 35 so as to divide the respective ink reservoir portions R from one another. Thus, the ink reservoir portion R has a vacant region 16 having no ink absorption member 37 that is provided between the ink absorption member 37 and the gas-liquid separation member 33.

FIG. 7 and FIG. 8 illustrate the condition just before the ink reservoir portion R is filled up with ink by an ink refill in the pit-in method as described above.

When the air in the ink reservoir portion R is exhausted from the vent hole 15 via the gas-liquid separation member 33, the interior of the ink reservoir portion R is gradually filled with ink from the lower part to the upper part in the gravitational direction of the ink absorption member 37. When ink reaches the vacant region 16 of the ink absorption member, ink is instantaneously filled to the region 16 because the region 16 does not have the ink absorption member 37. Then, as shown in a part 17R in FIG. 7 and FIG. 8, ink is finally filled at a predetermined point in the gas-liquid separation member 33.

The part 17R to which ink is finally filled as described above represents a position at which a very high pressure called water hammer is applied to the gas-liquid separation member 33 when air passes through the gas-liquid separation member 33. The part at which the phenomenon as described above is caused will be called as "defoaming point" for convenience. When an ink supply to the ink reservoir portion R is repeated, a risk may be caused in which a high pressure caused at the defoaming point 17R deteriorates the gas-liquid separation capability of the gas-liquid separation member 33 at the defoaming point 17R. Thus, the defoaming point 17R is also a damage point of the gas-liquid separation member 33. When the gas-liquid separation capability of the gas-liquid separation member 33 is decreased, a risk may be caused in which ink gradually leaks from the gas-liquid separation member 33 to the exhaust path 36. The position of the defoaming point 17R as described above is positioned almost at the center of the ventilation face 18 of the gas-liquid separation member 33 positioned in the ink reservoir portion R. However, the position of the defoaming point 17R is slightly different depending on the shape of the ink reservoir portion R.

When the gas-liquid separation capability of the gas-liquid separation member 33 is decreased, a risk may be caused in which a large amount of ink leaks to the exhaust path 36 to deteriorate the air permeability of the gas-liquid separation member 33 to prevent ink from being supplied properly. When ink leaks from the air inlet 15 to outside, a risk may be caused in which the interior of the ink jet printing apparatus is soiled or a printing medium is soiled during a printing operation.

SUMMARY OF THE INVENTION

It is an objective of the present invention to provide an ink supply method and a printing apparatus by which, when ink supply is repeated by using a gas-liquid separation member, damage to the gas-liquid separation member is reduced to improve the reliability.

In the first aspect of the present invention, there is provided a method for supplying ink into an ink container via an ink supply opening by aspirating air in the ink container via a gas-liquid separation member that permits gas to pass therethrough and that blocks liquid to pass therethrough, wherein:

a plurality of different amounts are set as an suction amount of air in the ink container per a unit time.

In the second aspect of the present invention, there is provided a printing apparatus that can print an image by ink replenished from a main tank to a sub tank, comprising:

suction means for aspirating air in the sub tank through a gas-liquid separation member that permits gas to pass therethrough and that blocks liquid to pass therethrough;

ink refill means for replenishing ink in the main tank into the sub tank via an ink supply opening depending on the suction by the suction means of air in the sub tank; and setting means for setting a plurality of different amounts as an suction amount of air per a unit time by the suction means.

According to the present invention, an ink supply method for supplying ink into an ink container by aspirating air in the ink container via a gas-liquid separation member sets a plurality of suction amounts of the air in the ink container per a unit time, thereby providing different ink flows in the ink container. As a result, intensive damage to the gas-liquid separation member that is caused when the ink flow is fixed can be dispersed. This can reduce, when an ink supply operation is repeated by using the gas-liquid separation member, intensive damage to the gas-liquid separation member, thereby improving the durability and reliability of the gas-liquid separation member and thus the reliability of the printing apparatus.

More specifically, defoaming points as a damage point caused in the gas-liquid separation member can be dispersed to improve the durability of the gas-liquid separation member, thereby preventing ink from leaked from the gas-liquid separation member.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, an embodiment of the present invention will be described with reference to the drawings.

Figure 2:
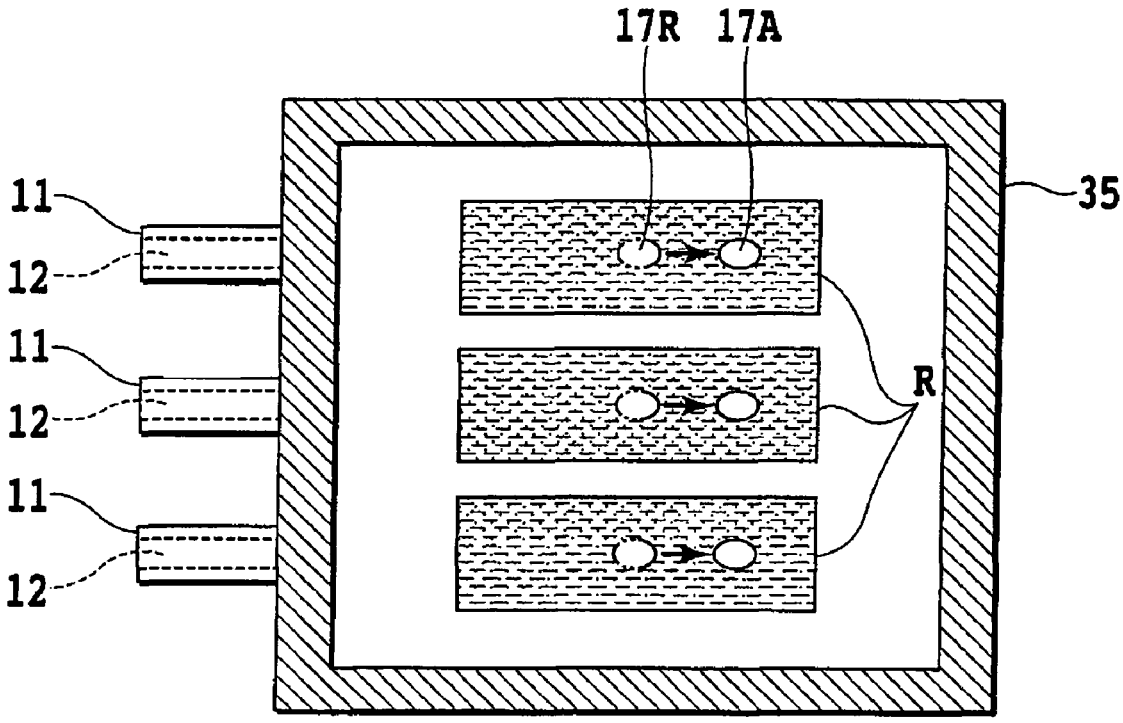
FIG. 2 is a cross-sectional view taken along the line II-II of FIG. 1.
Figure 3:
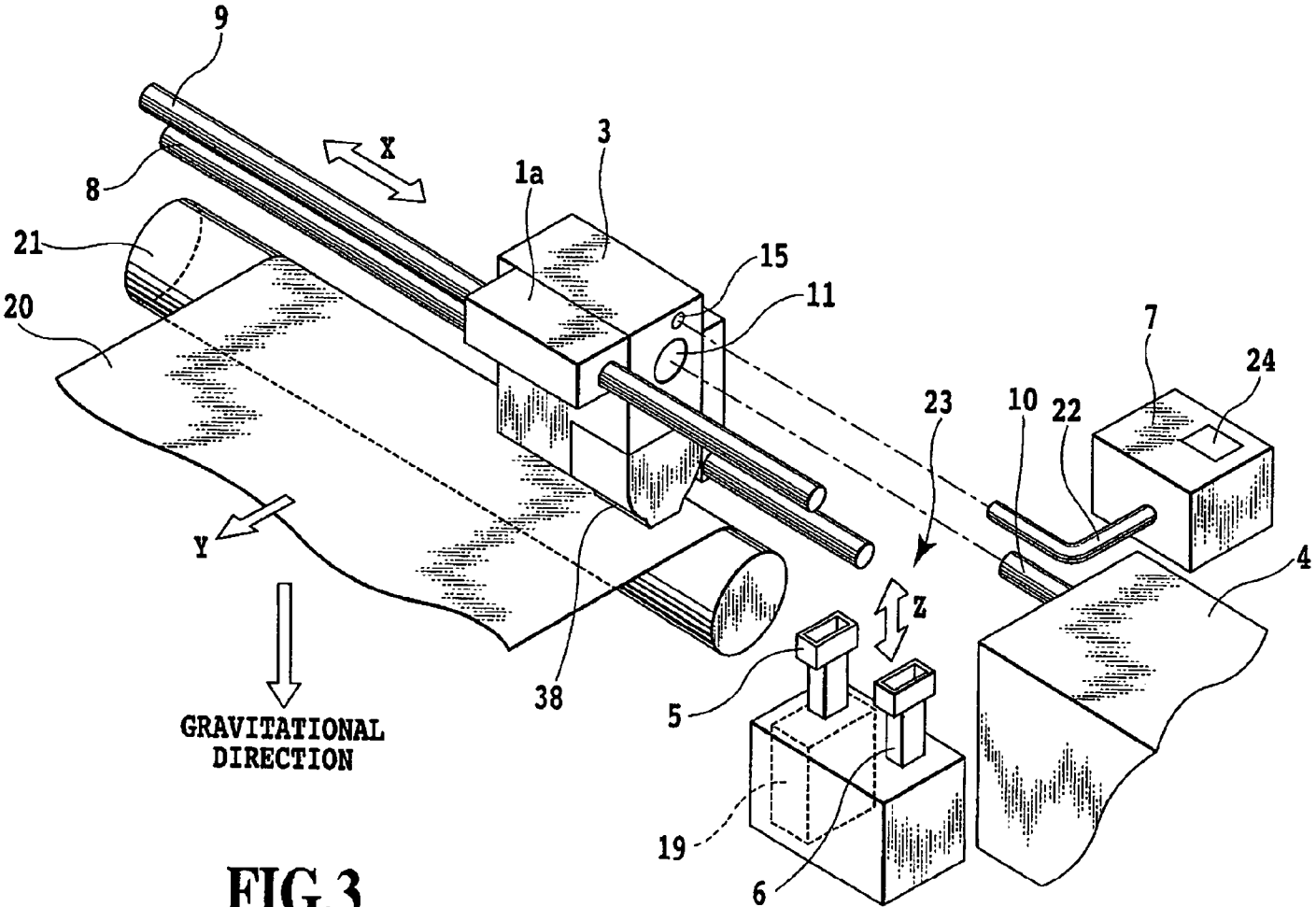
FIG. 3 is a perspective view illustrating the main part of a pit-in type ink jet printing apparatus using the sub tank of FIG. 1.

FIG. 3 is a perspective view illustrating the main part of a pit-in type ink jet printing apparatus in this embodiment. In order to print a printing paper (printing medium) 20 transported by a paper feeding roller 21, a printing head is mounted on a carriage 11*a* of a serial scan type ink jet printing apparatus. The printing head has the same structure as that of FIG. 5 and FIG. 6 as in FIG. 1 and FIG. 2 and includes a sub tank (ink container) 3 and an ink jet printing element 38. A carriage 1*a* is guided by a guide axis 8 and is engaged with a lead screw 9. When the lead screw 9 is rotated, the carriage 1*a* is moved along the guide axis 8 in the main scanning direction shown by the arrow X.

The main tank 4 for storing therein ink to be supplied to the sub tank 3 is provided at the predetermined home position 23 at the body of the printing apparatus. This main tank 4 includes a joint 10 for coupling with the ink supply opening 11 of the sub tank 3. The home position 23 includes the dummy cap 6 for sealing and protecting the ink ejection opening of the ink jet printing element 38; and an suction cap 5 for aspirating such ink from the ink ejection opening of the ink jet printing element 38 that does not contribute to the printing of an image. These caps 6 and 5 are moved, when the ink jet printing element 38 is moved to the home position 23, along the direction shown by the arrow Z in the upward direction, thereby capping the ink ejection opening. The interior of these caps 6 and 5 is communicated with an suction recovery pump 19. The home position 23 also includes an suction cap 22 for inspiring air from the vent hole 15 of the sub tank 3. The interior of the suction cap 22 is communicated with a negative pressure generating unit 7.

Figure 4:
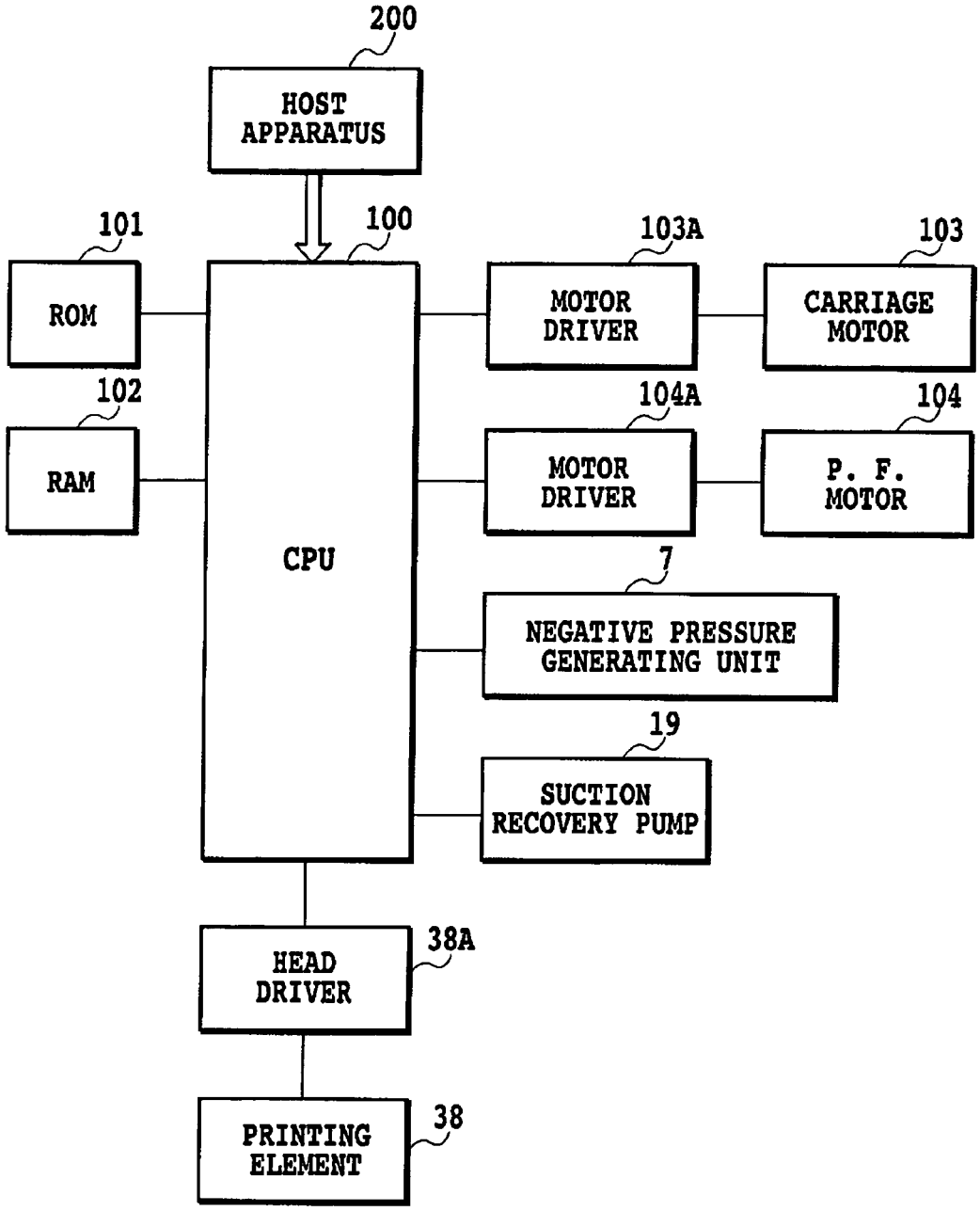
FIG. 4 is a schematic block diagram of a control system of the ink jet printing apparatus of FIG. 3.

FIG. 4 is a schematic block diagram illustrating the main part of a control system in the printing apparatus as described above. In FIG. 4, a CPU 100 executes a control processing or a data processing for example of the operation of this printing apparatus. A ROM 101 stores therein programs such as those for these processing procedures. A RAM 102 is used as a work area for executing these processings. The printing element 38 of the printing head is driven by the head driver 38A. The printing element 38 ejects ink by an electric heat converter (heater) or a piezo element. When the electric heat converter is used, ink is foamed by heat generated by the electric heat converter to use the foaming energy to eject ink from the ink ejection opening. In this case, the CPU 100 supplies driving data (image data) of the electric heat converter and a driving control signal (heat pulse signal) to the head driver 38A, thereby driving the printing element 38. The image data is sent from a host apparatus 200 (e.g., personal computer).

The CPU 100 controls a carriage motor 103 for driving the carriage 1*a* in the main scanning direction via a motor driver 103A and controls a P. F motor 104 for transporting the printing paper 20 in the sub scanning direction shown by the arrow Y of FIG. 3 via a motor driver 104A. Furthermore, the CPU 100 controls the negative pressure generating unit 7 and the suction recovery pump 19 as described later.

Figure 5:
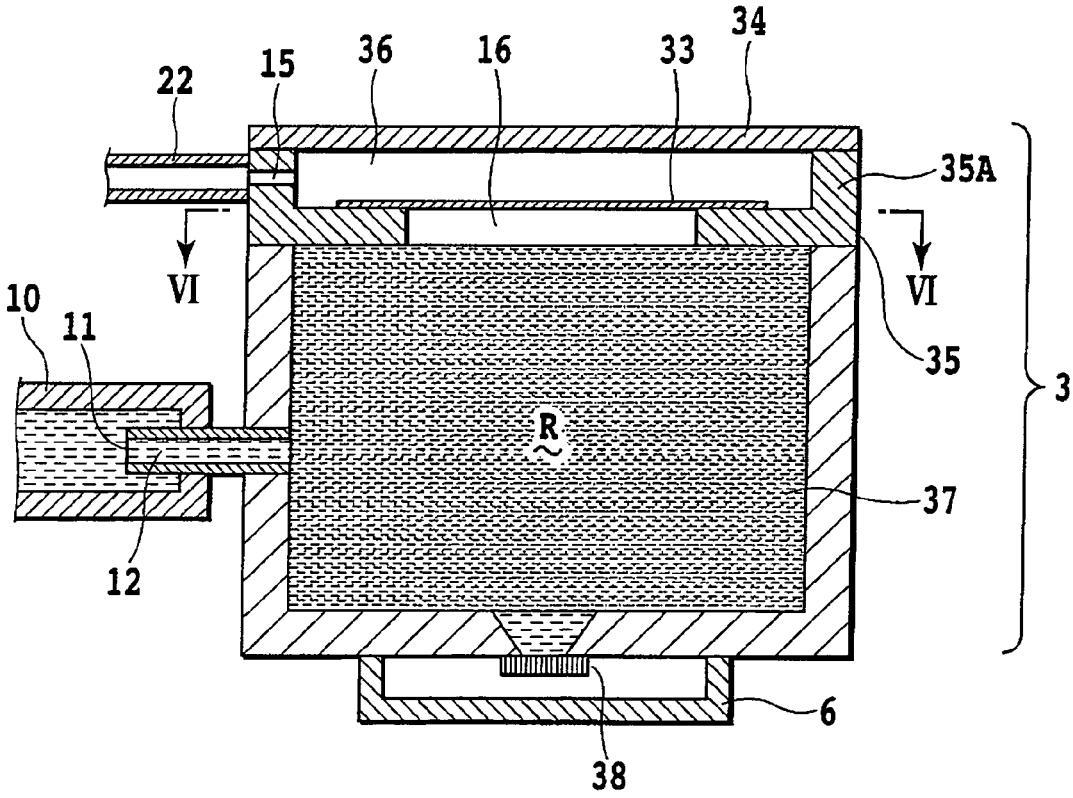
FIG. 5 is a cross-sectional view illustrating a sub tank used in a conventional pit in type ink jet printing apparatus.
Figure 6:
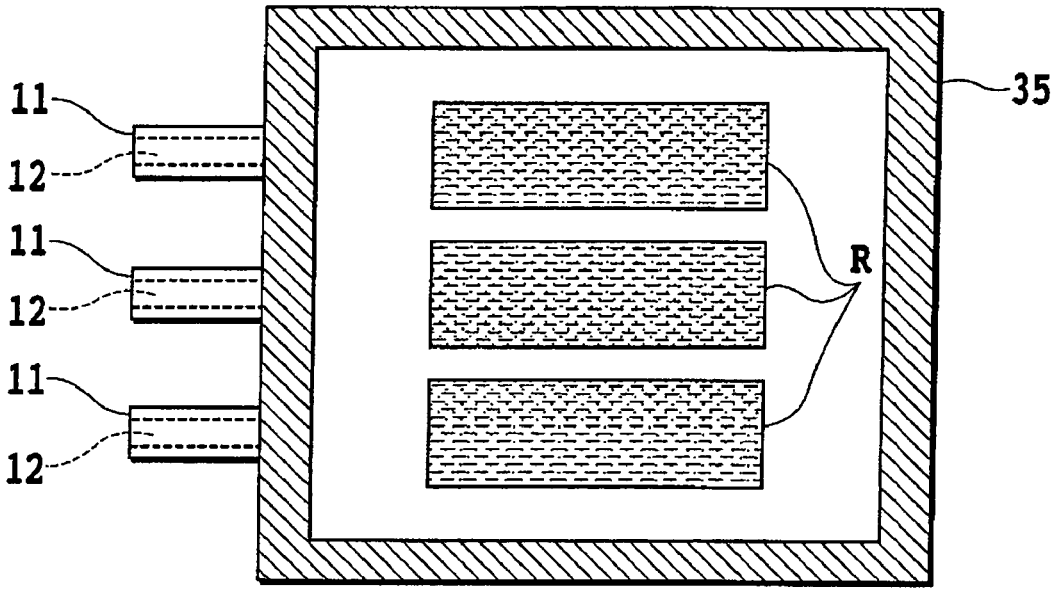
FIG. 6 is a cross-sectional view taken along the line VI-VI of FIG. 5.

As described above, the printing head (see FIG. 1 and FIG. 2) of this embodiment has the same structure as those of FIG. 5 and FIG. 6 and the structure will not be described further.

Next, a basic operation will be described.

During a non-printing operation, the printing head waits at the home position 23 at which the printing head can be connected with the suction cap 5, the suction cap 22, the dummy cap 6, and the main tank 4. When the host apparatus 200 sends a printing signal to the printing apparatus, an ink refill operation and a recovery operation are performed prior to a printing operation.

The ink refill operation is basically the same as those in FIG. 5 and FIG. 6 described above. First, the dummy cap 6 seals the ejection opening of the ink jet printing element 38 and the joint 10 of the main tank 4 is connected to the ink supply opening 11 of the sub tank 3. Then, the suction cap 22 is connected to the vent hole 15 of the sub tank 3 to subsequently activate the negative pressure generating unit 7 to decompress the interior of the sub tank 3. As a result, ink is replenished from the main tank 4 to the sub tank 3 as in the above-described cases of FIG. 5 and FIG. 6. The negative pressure generating unit 7 includes a limit valve 24 to limit a negative pressure generated by the negative pressure generating unit 7 to be equal to or lower than a predetermined value so that a high negative pressure is not applied to the gas-liquid separation member 33.

In addition to the basic ink refill operation as described above, the ink refill operation of this embodiment performs a characteristic operation as described later.

The subsequent recovery operation is an operation for maintaining the ink ejecting performance of the printing head in a favorable condition. The subsequent recovery operation prevents the printing head from having a deteriorated ink ejecting performance due to the back flow of ink in the nozzle of the printing head to the sub tank 3 during the decompression of the interior of the sub tank 3 or clogging of thickened ink in the nozzle for example. Specifically, the vent hole 15 and the ink supply opening 11 of the sub tank 3 are released to connect the ink jet printing element 38 to the suction cap 5, thereby operating the suction recovery pump 19. As a result, ink not contributing to the printing of an image is exhausted from the nozzle into the suction cap 5. Furthermore, the suction and exhaust of ink as described above are followed by a wiping operation for wiping ink attached to an ink ejection opening surface of the ink jet printing element 38 (surface at which the ink ejection opening is formed) and a preliminary ejection. This preliminary ejection is an operation for ejecting ink not contributing to the printing of an image via an ink ejection opening and can remove color mixture ink pushed into the nozzle by the wiping.

The recovery operation as described above is followed by a printing operation based on a printing signal.

Figure 1:
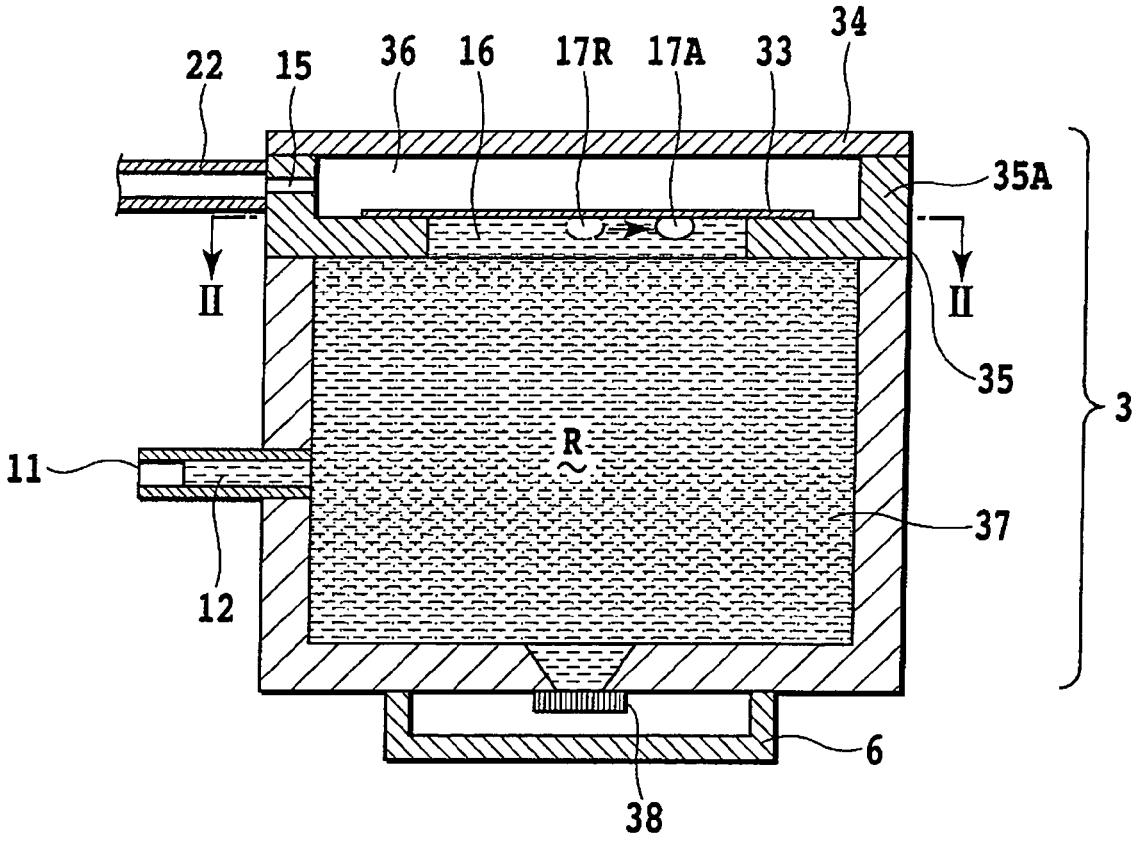
FIG. 1 is a cross-sectional view of a sub tank in one embodiment of the present invention.

FIG. 1 and FIG. 2 illustrate the condition just before the ink reservoir portion R is filled up with ink when ink is filled in the ink reservoir portion R of a printing head.

In this embodiment, design parameters of the printing apparatus and the printing head are determined as described below. The maximum amount of ink filled into the respective ink reservoir portions R is 0.44 $cm^3$ and an area of the ventilation face 18 of the gas-liquid separation member 33 in each ink reservoir portion R is 0.14 $cm^2$. The suction amount of the negative pressure generating unit 7 during an ink refill (i.e., suction amount of one ink refill operation) is 2 $cm^3$ and the suction rate (i.e., an suction amount per a unit time) is 0.13 $cm^3$/sec. The ink supply path 12 has an inner diameter of 0.36 mm and a length of 15.6 mm. The gas-liquid separation member 33 is a porous film made of PTFE having a thickness of several micrometers and has an air permeability of 0.000013 $cm^3$/pa/sec. The negative pressure generating unit 7 is a syringe pump and includes a limit valve 24 structured to leak air at 80 kpa. This limits a negative pressure applied to the gas-liquid separation member 33 to 0.2 atm, thereby preventing an excessive negative pressure from being applied to the gas-liquid separation member 33.

Figure 7:
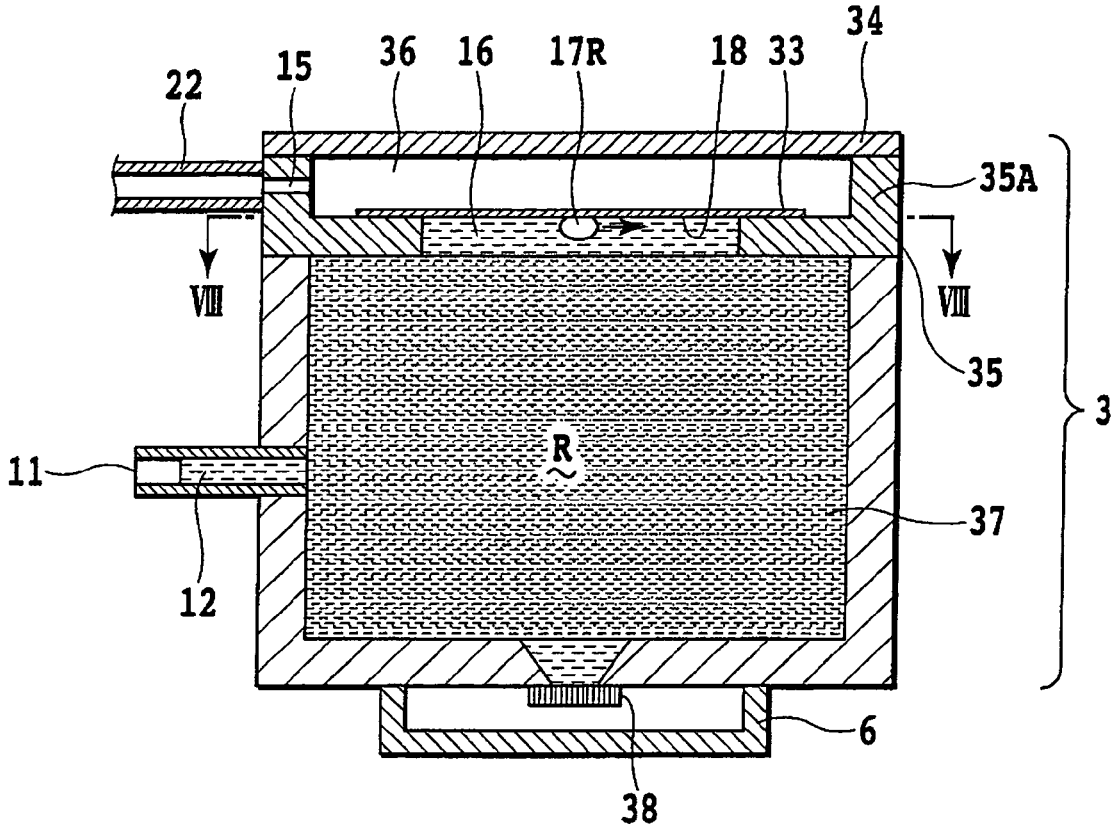
FIG. 7 is a cross-sectional view illustrating the ink supply status of the sub tank of FIG. 5.
Figure 8:
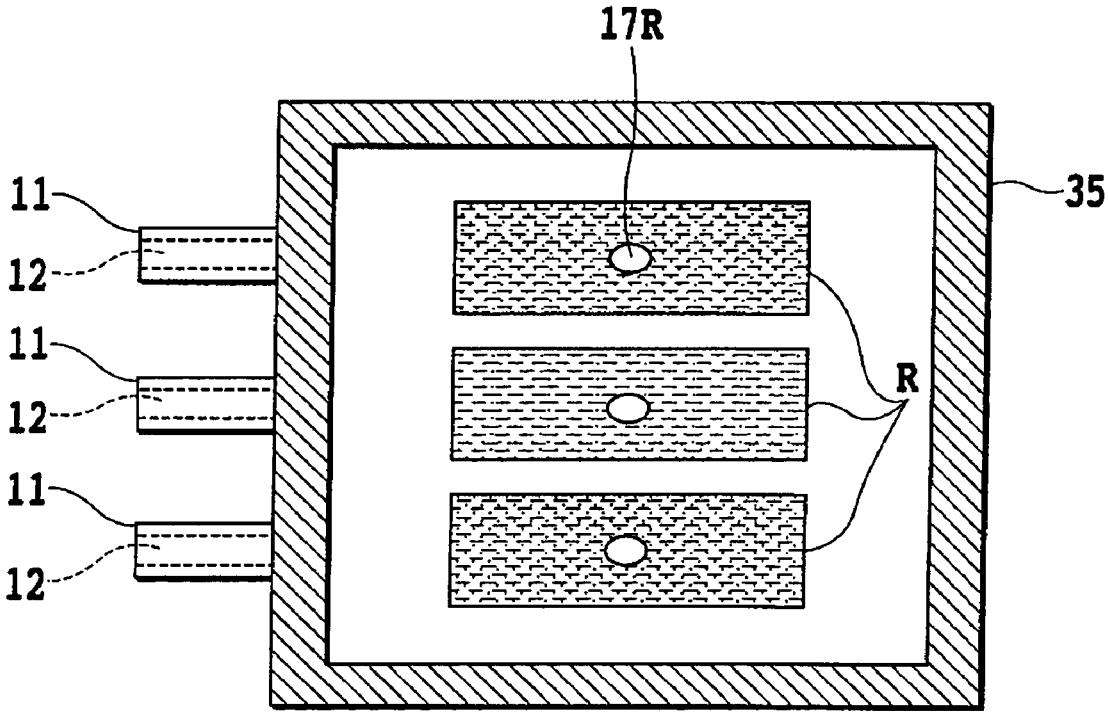
FIG. 8 is a cross-sectional view taken along the line VIII-VIII of FIG. 7.
Figure 9:
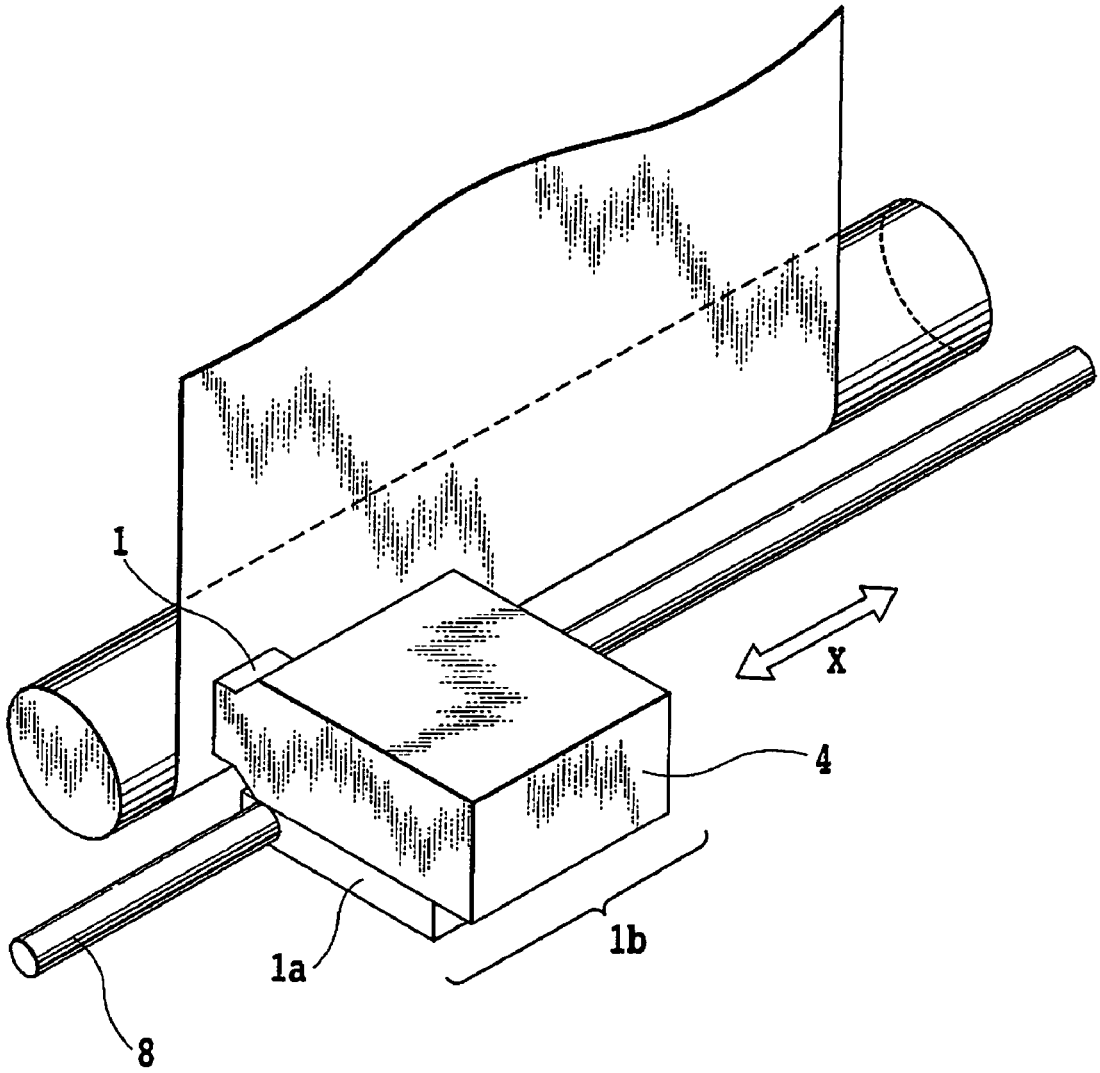
FIG. 9 is a perspective view illustrating the main part of a conventional head cartridge type ink jet printing apparatus.
Figure 10:
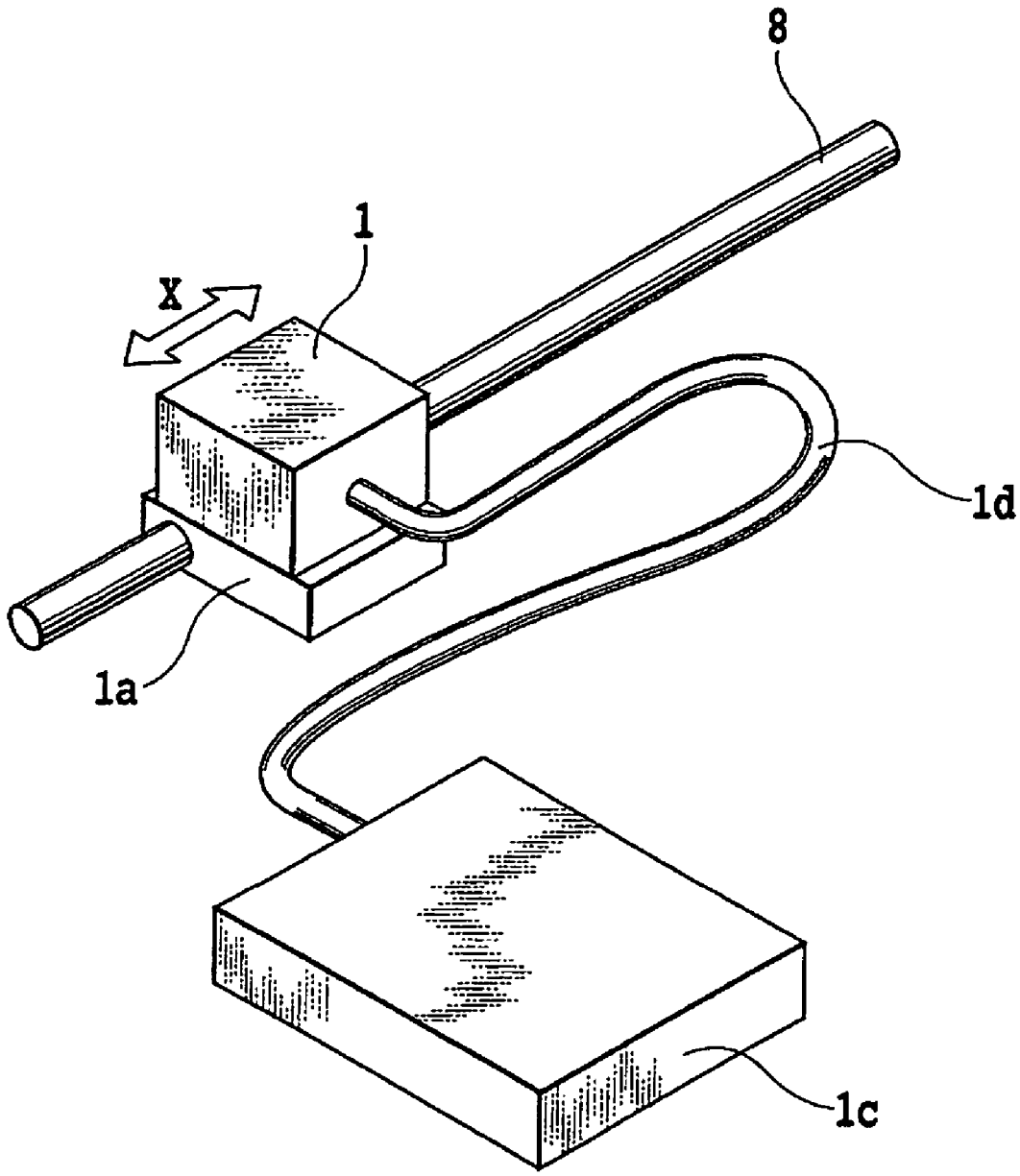
FIG. 10 is a schematic perspective view illustrating a conventional tank cartridge type ink jet printing apparatus.

This embodiment is structured so that the suction rate of the negative pressure generating unit 7 can be changed. Thus, ink can be replenished by a plurality of different suction rates. The above suction rate of 0.13 $cm^3$/sec is an average suction rate of the negative pressure generating unit 7 when the negative pressure generating unit 7 aspirates air during an ink refill. In the ink refill operation in FIG. 7 and FIG. 8 as described above, the suction rate of the negative pressure generating unit is fixed at 0.13 $cm^3$/sec for example.

Hereinafter, the characteristic ink refill operation of this embodiment will be described.

When a printing signal is sent from the host apparatus 200 to the ink jet printing apparatus, an ink refill operation is started if the remaining amount of ink in the sub tank 3 is equal to or lower than a predetermined amount. When the sub tank 3 is not positioned at the home position 23, the lead screw 9 is rotated and the carriage 1*a* and the sub tank 3 are moved to the home position 23 to subsequently perform an ink refill operation. The ink jet printing apparatus includes a counter (not shown) for counting the number of ink refill(s) under the control by the CPU 100; and a control section for changing the suction rate of the negative pressure generating unit 7 whenever a predetermined number of ink refill(s) is reached (ten ink refills in this example).

In this example, the suction rate of the negative pressure generating unit 7 during the ink refill operation is controlled in two steps. Thus, first and second suction conditions are set as shown below.

(First Suction Conditions)

Until the ink refill operation is performed ten times, the suction amount of the negative pressure generating unit 7 is maintained at 2 $cm^3$ and the suction rate is maintained at 0.13 $cm^3$/sec. The suction amount of the negative pressure generating unit 7 is maintained at 2 $cm^3$ that is larger than the total of the maximum amounts of ink filled into the respective ink reservoir portions R. Thus, the ink refill operation can be performed securely as described above. The defoaming point 17R to which ink is finally filled during the ink refill operation is positioned, as shown in FIG. 1 and FIG. 2, substantially at the center of the ventilation face 18. When the ten repetitions of the ink refill operation based on the first suction conditions as described above in relation with the printing operation is detected by the counter, then the subsequent eleventh ink refill operation is performed based on the second suction conditions.

(Second Suction Conditions)

When the number of repetitions of the ink refill operation is within a range from eleven to twenty, the suction amount of the negative pressure generating unit 7 is maintained at 2 $cm^3$ and the suction rate is set to be 0.4 $cm^3$/sec that is higher than that in the first suction conditions. According to an observation, a defoaming point to which ink is finally filled in this ink refill operation is found to be a defoaming point 17A as shown in FIG. 1 and FIG. 2 that is different from the defoaming point 17R in the first suction conditions. It was also observed that the variation of the defoaming point 17A is larger than the variation of the defoaming point 17R. The defoaming points 17R and 17A in FIG. 1 and FIG. 2 represent the centers of the distribution of the defoaming points, respectively. When the negative pressure generating unit 7 has an increased suction rate, ink replenished to the sub tank 3 also has an increased flow rate. The ink filling rate is also different depending on a position within the ink reservoir portion R. Thus, a different ink flow rate causes a change in the difference of the ink filling rate depending on a position within the ink reservoir portion R. As a result, the change in the suction rate causes the variation of the defoaming point as described above.

Thereafter, whenever the ink refill operation is repeated ten times, the first suction conditions and the second suction conditions are set alternately. For example, the first suction conditions are set in a range from the 21th to 30th operations and the second suction conditions are set in a range from 31th to 40th operations. The first and second suction conditions are alternately set to perform the ink refill.

By changing the suction conditions to disperse defoaming points at which water hammer is caused as described above, damage to the gas-liquid separation member 33 can be reduced so that the gas-liquid separation member 33 can have an improved durability. As a result of an endurance test of the gas-liquid separation member 33, the repetition of ink refill based on two types of suction conditions as in this example showed a durability of the gas-liquid separation member 33 that is about 1.5 times higher than that by a conventional system where ink refill is repeated based on one type of suction conditions.

OTHER EMBODIMENTS

In the above-described examples, the two types of suction conditions were alternately set whenever an ink refill operation is repeated ten times. However, the change of the suction conditions is not limited to this and may be performed in an arbitrary manner. For example, suction conditions also may be changed whenever an ink refill operation is performed one time or suction conditions also may be changed randomly. Suction conditions that can be set are not limited to the two types and also may be an arbitrary number of types. For example, three or more types of suction conditions can further disperse defoaming points to further improve the durability of the gas-liquid separation film 33. Alternatively, suction conditions also may be changed within one refill operation.

Optimal suction conditions are different depending on the shape of the gas-liquid separation member 33, the type of ink, the shape of the ink reservoir portion R in an ink tank for example and thus are determined depending on these factors.

For example, the value of an suction rate, the number of suction rate(s) that can be set, or an order of a change of an suction rate for example can be selected depending on the system configuration or the design objective of the ink jet printing apparatus for example. Furthermore, although the above-described example has set the suction conditions depending on the number of ink supplies, the present invention is not limited to this. For example, the next suction conditions also may be set depending on a time that has passed after an ink supply. Any type of suction conditions may be used so long as the suction rate of the negative pressure generating unit (i.e., suction amount per a unit time) during an ink refill is changed to change the ink flow in the ink tank so that intensive damage to the gas-liquid separation member that is caused when the ink flow is fixed can be dispersed. For example, any type of suction conditions may be used so long as the durability of the gas-liquid separation member can be improved by changing an ink supply rate to an ink tank to disperse defoaming points (which are damage points to the gas-liquid separation member) as described above.

Furthermore, an ink tank to which ink is replenished is not limited to the sub tank as described above and may be an arbitrary tank. Any ink tank may be used so long as the interior thereof can be aspirated through the gas-liquid separation member so that ink can be replenished into the ink tank. Thus, an ink tank is not limited to the one in the printing head having the structure as described above in which a printing element and an ink tank are provided. Thus, an ink tank also may be separately provided from a printing head or may be used in various printing apparatuses other than those according to the ink jet printing method.

The structure of an ink tank is also not limited to the above-described structure including an ink absorption member. For example, an ink tank also may have an arbitrary structure such as the one including no ink absorption member or the one partially including an ink absorption member. An ink tank having an arbitrary structure may be used so long as the structure can disperse, regardless of a region having no ink absorption member is formed actively or not, intensive damage to a gas-liquid separation member (more specifically, defoaming points as damage points to the gas-liquid separation member). It is also not always necessary to provide the gas-liquid separation member in the ink tank.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

This application claims priority from Japanese Patent Application No. 2005-185744 filed Jun. 24, 2005, which is hereby incorporated by reference herein.

What is claimed is:

1. A printing apparatus comprising:

a carriage mounted with an ink jet printing head for ejecting ink and a sub tank for storing ink to be supplied to the printing head, wherein the sub tank includes an ink supply opening which communicates with an interior of the sub tank;

a main tank provided on the printing apparatus, wherein the main tank stores ink to be supplied to the sub tank, and wherein the ink supply opening is configured to connect with the main ink tank so as to allow ink to be supplied from the main tank to the sub tank;

a gas-liquid separation member provided at a boundary portion between the interior of the sub tank and an exhaust path, wherein the gas-liquid separation member permits gas to pass through the gas-liquid separation member and blocks liquid from passing through the gas-liquid separation member, and wherein a defoaming point is defined at a position of the gas-liquid separation member through which air in a portion of the sub tank is exhausted, the portion being finally filled with ink;

a negative pressure generating unit for aspirating air in the sub tank through the exhaust path and the gas-liquid separation member so as to supply ink from the main tank to the sub tank through the ink supply opening; and a control unit for controlling the negative pressure generating unit so as to change the position of the defoaming point, wherein in order to change the position of the defoaming point the control unit changes a suction rate of the negative pressure generating unit depending on the number of times ink has been supplied from the main tank to the sub tank.

2. The printing apparatus according to claim 1, wherein the carriage is mounted with a plurality of sub tanks, each storing a respective one of a plurality of different inks.

3. The printing apparatus according to claim 2, wherein the gas-liquid separation member is common to the plurality of sub tanks.

4. The printing apparatus according to claim 1, further comprising a dummy cap for capping the ink jet printing head during the time that ink is supplied from the main tank to the sub tank.

5. The printing apparatus according to claim 1, wherein the gas-liquid separation member is a porous film.

6. The printing apparatus according to claim 1, wherein the control unit maintains the suction rate at a first predetermined level for a first predetermined number of ink supply times, and maintains the suction rate at a second predetermined level higher than the first predetermined level for a second predetermined number of ink supply times after the first predetermined number of ink supply times.

7. The printing apparatus according to claim 6, where the first predetermined level is substantially around 0.13 $cm^3$/sec, the second predetermined level is substantially around 0.40 $cm^3$/sec, and the first and second predetermined number of supply times are both substantially around ten.

8. The printing apparatus according to claim 6, wherein after the second predetermined number of supply times, the first and second predetermined levels are repeated alternately.

* * * * *